United States Patent [19]

West

[11] Patent Number: 4,497,484

[45] Date of Patent: Feb. 5, 1985

[54] PLAYGROUND CLIMBER

[75] Inventor: Donald E. West, Fort Payne, Ala.

[73] Assignee: Game Time, Inc., Fort Payne, Ala.

[21] Appl. No.: 469,805

[22] Filed: Feb. 25, 1983

[51] Int. Cl.[3] ..... A63B 17/04

[52] U.S. Cl. ..... 272/113; D21/245; 272/56.5 R

[58] Field of Search ..... 272/111-113, 272/115, 63, 56.5 R; D21/244-245; 104/53, 56, 63; 52/639; 46/220, 28

[56] References Cited

U.S. PATENT DOCUMENTS

| | | | |
|---|---|---|---|
| D. 178,253 | 7/1956 | Martens | D21/245 |
| D. 250,785 | 1/1979 | Dieter et al. | D21/245 |
| D. 263,983 | 4/1982 | Carlson | D21/245 |
| 1,976,188 | 10/1934 | Nozawa | 52/639 |
| 2,953,394 | 9/1960 | Anderson | 272/115 |
| 2,984,937 | 5/1961 | Rendon | 46/220 |
| 3,814,416 | 6/1974 | Munger et al. | 272/56.5 R |
| 4,184,271 | 1/1980 | Barnett | 46/28 |

FOREIGN PATENT DOCUMENTS

| | | | |
|---|---|---|---|
| 3001450 | 7/1980 | Fed. Rep. of Germany | 104/56 |

*Primary Examiner*—Richard J. Apley
*Assistant Examiner*—S. R. Crow
*Attorney, Agent, or Firm*—Lalos, Leeds, Keegan, Lett, Marsh, Bentzen & Kaye

[57] ABSTRACT

A children's climber for parks and playgrounds generally consisting of a first arcuately shaped rail member having end portions supportable on the ground, a second arcuately-shaped rail member having end portions supportable on the ground, such rail members lying in intersecting planes, and a plurality of rungs interconnecting the rail members providing a helical climbing course.

16 Claims, 4 Drawing Figures

PLAYGROUND CLIMBER

This invention relates to park and playground equipment and more particularly to climbing equipment for children.

Climbing equipment for parks and playgrounds traditionally has been simple and basic in design, providing little to stir the imagination of children. With the advent of the Space Age and travel in outer space, it has been found to be desirable to provide a piece of climbing equipment which comports with the current interest in space, stimulates the imagination of children and yet is durable in construction to provide a long service life and challenging in configuration to promote proper bodybuilding exercises.

Accordingly, it is the principal object of the present invention to provide a plaything suitable for use in parks and playgrounds for children.

Another object of the present invention is to provide a novel plaything suitable for use by children in parks and playgrounds which is imaginative in construction.

A further object of the present invention is to provide a novel climbing apparatus for use by children in parks and playgrounds which connotes space travel in its design.

A still further object of the present invention is to provide a novel climbing apparatus suitable for use by children in parks and playgrounds which not only is imaginative in design but durable in construction and challenging in configuration.

Another object of the present invention is to provide a novel climbing apparatus for use by children in parks and playgrounds which has a high level of play value.

A further object of the present invention is to provide a novel climbing apparatus suitable for erecting in parks and playgrounds for use by children which is designed for ease of assembly and for minimum maintenance.

Other objects and advantages of the present invention will become more apparent to those persons having ordinary skill in the art to which the present invention pertains from the following description taken in conjunction with the accompanying drawings, wherein.

Figure 1:
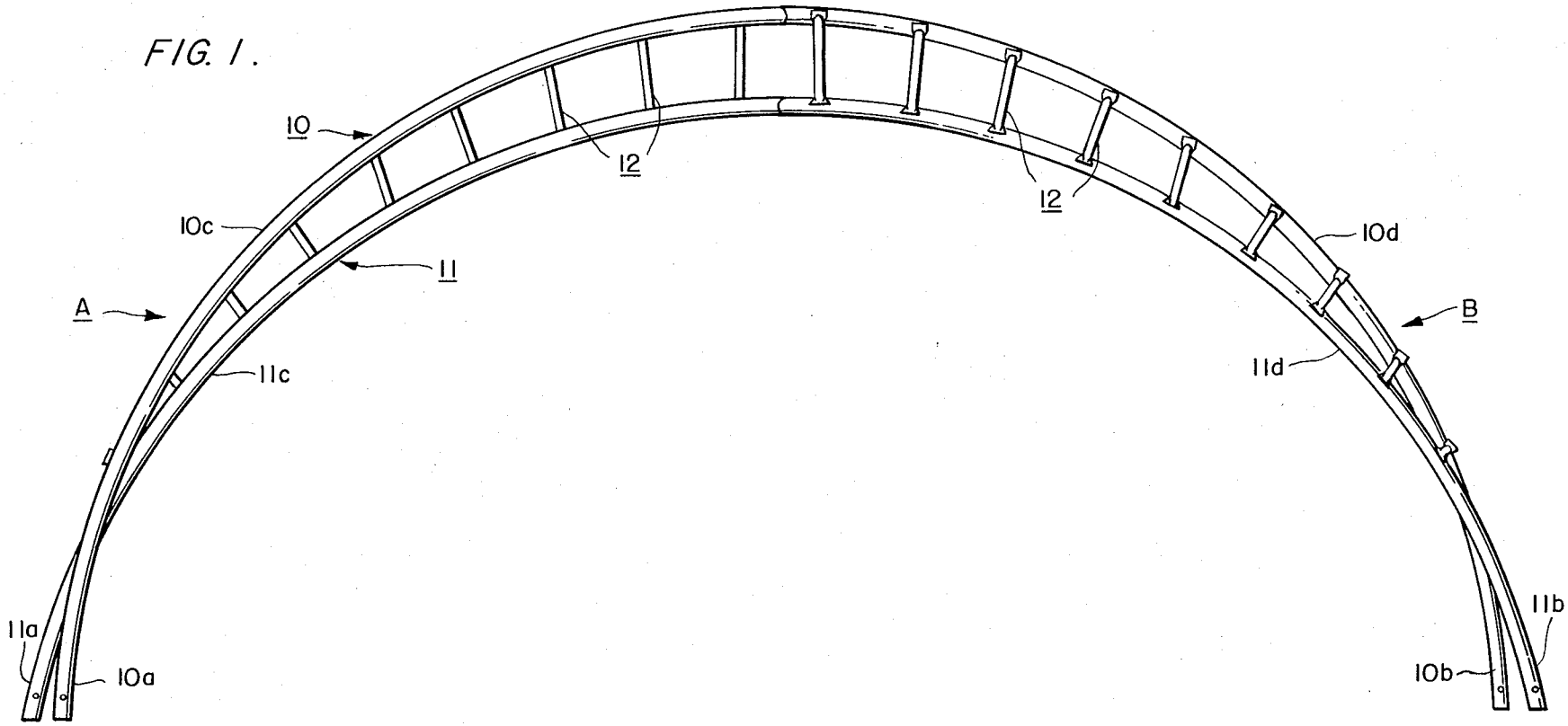
FIG. 1 is a side-elevational view of the preferred embodiment of the invention.
Figure 2:
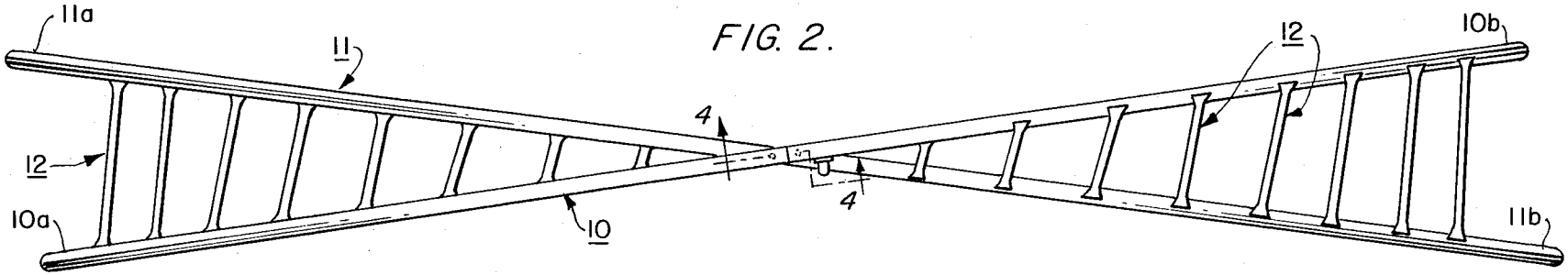
FIG. 2 is a top plan view of the embodiment shown in FIG. 1.
Figure 3:
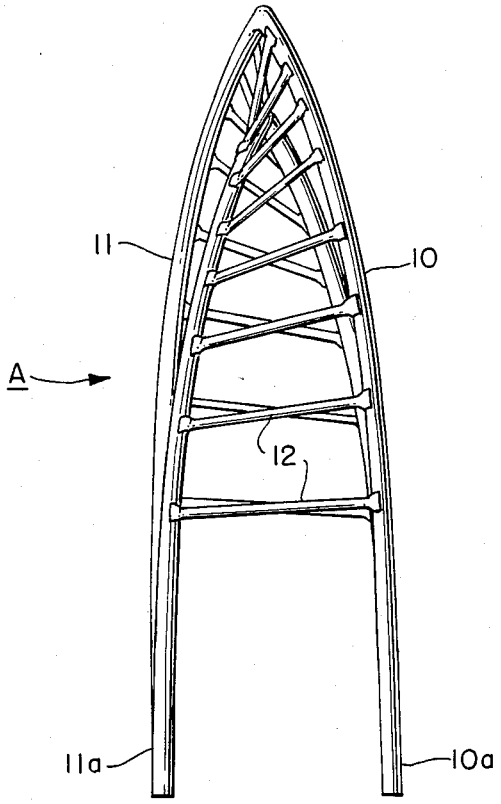
FIG. 3 is a front-elevational view of the embodiment shown in FIGS. 1 and 2.

Generally, the present invention includes a set of rails 10 and 11 and a plurality of rungs 12. When fully erected, rail member 10 will lie in a substantially vertical plane with its end portions 10*a* and 10*b* supported on or in the ground, and rail member 11 similarly will lie in a substantially vertical plane with the end portions 11*a* and 11*b* being supported on or in the ground. As best shown in FIG. 2, the planes in which rail members 10 and 11 lie intersect each other at approximately the midpoints of their lengths so that leg portions 10*a* and 11*a* are spaced a small distance apart and end portions 10*b* and 11*b* are similarly spaced a small distance apart. The radius of rail member 10 is slightly greater than the radius of rail member 11 so that the midpoints of the rail members, where they intersect, are spaced vertically as best shown in FIG. 1.

Rungs 12 interconnect rail members 10 and 11 and are spaced along the lengths thereof so that they lie in a substantially helical plane. Each of the rungs is of a tubular construction having the end portions thereof flattened and rigidly secured by welding to the rail members.

Figure 4:
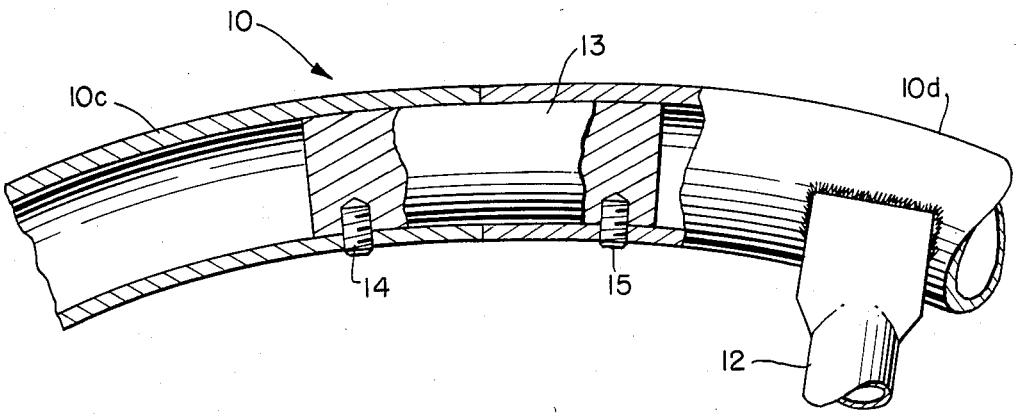
FIG. 4 is an enlarged cross-sectional view taken along Line 4—4 in FIG. 2.

Rail member 10 is formed of two arcuately shaped tubular portions 10*c* and 10*d* which abut at their upper ends and are rigidly secured together by a coupling pin 13 as best seen in FIG. 4. The coupling pin is received within the abutting ends of tubular portions 10*c* and 10*d* and is secured in position by means of a pair of set screws 14 and 15. Similarly, rail member 11 is formed from a pair of arcuately shaped tubular portions 11*c* and 11*d* having their upper ends abutting and joined together by a similar coupling pin. In essence, the entire climbing apparatus is constructed in two sections, a section A consisting of rail segments 10*c* and 11*c* interconnected by a set of rungs 12 and a section B consisting of rail segments 10*d* and 11*d* interconnected by a second set of rungs 12. In this regard, it is contemplated that the embodiment as described would be fabricated at a manufacturing site in sections A and B which would be transported to a selected site at a park or playground for final erection.

In erecting the equipment, it is important that the supporting end portions of the rail members be firmly anchored in the ground. Preferably, such end portions should be embedded in concrete to prevent such end portions from becoming uprooted and causing the equipment to topple. In the preferred method of erection, the locations of where the end portions of the rail members will be positioned are determined, footings are dug at such locations, sections A and B of the equipment are assembled together with coupling pins 12 and set screws 13, the end portions of the unit are positioned in the footing holes, the unit is braced in its desired position and concrete is poured in the footing holes to embed the end portions of the rail members. After the concrete has set, the bracing devices are removed, the unfilled portions of the footing holes may be filled with dirt, and sod may be placed around the lower ends of the rail members to provide an aesthetic and pleasing effect.

The rail segments and rungs may be formed of any sturdy material although it is preferred that such components be made of metal such as steel or aluminum. It furthermore is preferred that the end portions of the rungs be flattened as best shown in FIG. 4 to avoid any protrusions or sharp edges which may cause injury to children using the equipment, and to provide suitable mating surfaces for welding the rungs to the rail segments.

In use, as a child ascends one side of the equipment and begins to invert his or her orientation, the child may continue in an inverted attitude as he or she continues the climb or may climb onto the upper side of the equipment and continue climbing in the same attitude. Changing attitude as the child climbs the length of the equipment will give the illusion of being in outer space thereby stimulating the imagination of the child while promoting bodybuilding exercises.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A children's climbing apparatus suitable for use in parks and playgrounds comprising:

a first arcuate rail member having a pair of first member end portions supportable by the ground, a second arcuate rail member having a pair of second member end portions supportable by the ground, said first and second arcuate rail members lying generally in intersecting planes, said first and second arcuate rail members being positioned relative to each other and to a vertical plane having first and second sides such that one said first member end portion is positioned on said first side and the other said first member end portion is positioned on said second side and the one said second member end portion closest to said one said first member end portion is positioned on said second side and the other said second member end portion is positioned on said first side, and a plurality of children's climbing rungs interconnecting said first and second rail members.

2. The children's climbing apparatus of claim 1 including, said first and second arcuate rail members being positioned in vertical planes.

3. The children's climbing apparatus of claim 1 including, said rungs being of tubular construction and having flattened end portions welded to said first and second rail members.

4. The children's climbing apparatus of claim 1 including, each of said first and second arcuate rail members comprising first and second segments, providing a pair of sections consisting of a pair of rail segments interconnected by a set of rungs, and a securing means for rigidly securing said sections together.

5. The children's climbng apparatus of claim 4 including, said securing means including a pair of coupling pins disposed in abutting ends of said rail segments of said first and second arcuate rail members.

6. The children's climbing apparatus of claim 1 including, said first arcuate rail member having a radius of curvature greater than the radius of curvature of said second arcuate rail member, and said rungs being positioned in a helical plane.

7. The children's climbing apparatus of claim 1 including, said first and second arcuate rail members being symmetrical about a vertical plane.

8. The children's climbing apparatus of claim 1 including, said rung nearest one of the ends of said first arcuate rail member being generally horizontal, and said rung nearest the midpoint of said first arcuate rail member being generally vertical.

9. The children's climbing apparatus of claim 1 including, the midpoints of said first and second arcuate rail members being vertically spaced.

10. The children's climbing apparatus of claim 1 including, the highest point of said first arcuate rail member being spaced above the highest point of said second arcuate rail member.

11. The children's climbing apparatus of claim 1 including, said rungs being positioned in a helical plane.

12. The children's climbing apparatus of claim 1 including, said intersecting planes intersecting in the middle of said first and second arcuate rail members.

13. The children's climbing apparatus of claim 1 including, said pair of first member end portions and said pair of second member end portions being positioned in the same horizontal plane.

14. The children's climbing apparatus of claim 1 including, said children's climbing rungs being spaced and adapted to support and to be grasped by children climbing along the length of said first and second arcuate rail members.

15. The children's climbing apparatus of claim 1 including, each said rung being generally the same length.

16. A children's climbing apparatus suitable for use in parks and playgrounds comprising:

a first arcuate rail member having a pair of first member end portions supportable by the ground, a second arcuate rail member having a pair of second member end portions supportable by the ground, said first and second arcuate rail members lying generally in intersecting vertical planes intersecting in the middle of said first and second arcuate rail members and being symmetrical about a vertical plane, said first arcuate rail member having a radius of curvature greater than the radius of curvature of said second arcuate rail member, said pairs of first and second member end portions being positioned in the same horizontal plane, said first and second arcuate rail members being positioned relative to each other and to a vertical plane having first and second sides such that one said first member end portion is positioned on said first side and the other said first member end portion is positioned on said second side and the one said second member end portion closest to said one said first member end portion is positioned on said second side and the other said second member end portion is positioned on said first side, and a plurality of children's climbing rungs interconnecting said first and second rail members and positioned in a helical plane.

* * * * *